US007618527B2

(12) United States Patent
Schussler et al.

(10) Patent No.: US 7,618,527 B2
(45) Date of Patent: Nov. 17, 2009

(54) METHOD OF OPERATING A DIAPHRAGM ELECTROLYTIC CELL

(75) Inventors: Henry W. Schussler, Harrison City, PA (US); Joseph R. Cimini, Lake Charles, LA (US); Robert A. Fast, Westlake, LA (US); Berry G. Garrard, Lake Charles, LA (US); Steven T. Richardson, Lake Charles, LA (US)

(73) Assignee: PPG Industries Ohio, Inc., Cleveland, OH (US)

( * ) Notice: Subject to any disclaimer, the term of this patent is extended or adjusted under 35 U.S.C. 154(b) by 652 days.

(21) Appl. No.: 11/216,492

(22) Filed: Aug. 31, 2005

(65) Prior Publication Data

US 2007/0045105 A1 Mar. 1, 2007

(51) Int. Cl.
*C25B 15/00* (2006.01)
*C25B 13/08* (2006.01)
*C25B 1/46* (2006.01)

(52) U.S. Cl. ..... 205/350; 205/517

(58) Field of Classification Search ..... None
See application file for complete search history.

(56) References Cited

U.S. PATENT DOCUMENTS

| | | | | | |
|---|---|---|---|---|---|
| 3,385,915 | A | | 5/1968 | Hamling | |
| 4,036,729 | A | | 7/1977 | Patil et al. | |
| 4,118,308 | A | * | 10/1978 | Specht | 204/296 |
| 4,126,535 | A | | 11/1978 | Balko et al. | |
| 4,165,271 | A | | 8/1979 | Kadija | |
| 4,169,774 | A | | 10/1979 | Kadija et al. | |
| 4,174,266 | A | * | 11/1979 | Jeffery | 205/350 |
| 4,182,670 | A | * | 1/1980 | Argade et al. | 204/252 |
| 4,184,939 | A | | 1/1980 | Kadija | |
| 4,311,566 | A | | 1/1982 | McCann | |
| 4,315,061 | A | | 2/1982 | Clarizio | |
| 4,409,085 | A | | 10/1983 | Kadija et al. | |
| 4,417,959 | A | | 11/1983 | Kadija et al. | |
| 4,437,951 | A | | 3/1984 | Bissot et al. | |
| 4,517,064 | A | | 5/1985 | Cook | |
| 4,559,124 | A | | 12/1985 | Divisek et al. | |
| 4,666,573 | A | | 5/1987 | DuBois et al. | |
| 4,680,101 | A | | 7/1987 | Darlington et al. | |
| 4,720,334 | A | | 1/1988 | DuBois et al. | |
| 4,869,793 | A | | 9/1989 | Kinney | |
| 5,030,403 | A | | 7/1991 | Pickens et al. | |
| 5,188,712 | A | | 2/1993 | Dilmore et al. | |
| 5,192,401 | A | | 3/1993 | DuBois et al. | |
| 5,266,350 | A | * | 11/1993 | Grob et al. | 427/140 |
| 5,288,712 | A | | 2/1994 | Chen | |
| 5,470,449 | A | | 11/1995 | Bachot et al. | |
| 5,567,298 | A | | 10/1996 | DuBois et al. | |
| 5,584,977 | A | | 12/1996 | Bachot et al. | |
| 5,612,089 | A | | 3/1997 | Dilmore, Jr. et al. | |
| 5,630,930 | A | | 5/1997 | Maloney | |
| 5,683,749 | A | | 11/1997 | DuBois et al. | |
| 5,720,933 | A | | 2/1998 | Srinivasan | |
| 5,780,154 | A | | 7/1998 | Okano et al. | |
| 5,919,348 | A | | 7/1999 | Friedrich et al. | |
| 6,059,944 | A | | 5/2000 | DuBois et al. | |
| 6,296,745 | B1 | | 10/2001 | DuBois et al. | |
| 6,299,939 | B1 | | 10/2001 | DuBois et al. | |
| 6,352,660 | B1 | | 3/2002 | Friedrich et al. | |
| 6,395,080 | B1 | | 5/2002 | Cass et al. | |

FOREIGN PATENT DOCUMENTS

| | | |
|---|---|---|
| EP | 0 196 317 | 3/1990 |
| EP | 1 029 118 B1 | 8/2001 |
| EP | 0 865 517 B1 | 7/2002 |
| SU | 916603 B | 3/1982 |
| WO | WO 86/01841 | 3/1986 |

OTHER PUBLICATIONS

U.S. Appl. No. 11/184,967, entitled "Diaphragm For Electrolytic Cell," filed Jul. 20, 2005.
U.S. Appl. No. 11/334,907, entitled "Diaphragm For Electrolytic Cell," filed on Jan. 19, 2006.

* cited by examiner

*Primary Examiner*—Harry D Wilkins, III
(74) *Attorney, Agent, or Firm*—Linda Pingitore; Irwin M. Stein

(57) ABSTRACT

Describes a method for lowering the flow of liquid anolyte through perforations in the diaphragm of a diaphragm electrolytic cell, e.g., a chlor-alkali diaphragm electrolytic cell, comprising introducing ceramic fiber into the anolyte compartment of the electrolytic cell, e.g., during cell operation. The benefits described for lowering the flow of anolyte liquor through the diaphragm of a chlor-alkali diaphragm electrolytic cell are increasing the concentration of alkali metal hydroxide, e.g., sodium hydroxide, and decreasing the concentration of hypochlorite ion, e.g., sodium hypochlorite, in the catholyte liquor. Also describes introducing dopant material and/or fibers comprising halogen-containing polymer, e.g., fluorocarbon polymer fibers, into the anolyte compartment of the electrolytic cell in conjunction with the addition of ceramic fiber into the anolyte compartment, e.g., during cell operation.

16 Claims, No Drawings

METHOD OF OPERATING A DIAPHRAGM ELECTROLYTIC CELL

FIELD OF THE INVENTION

The present invention relates to electrolytic diaphragm cells for the electrolysis of inorganic materials, and to methods for operating such electrolytic cells. In one non-limiting embodiment of the present invention, the method relates to minimizing the effect of perforations that occur in the diaphragm of the electrolytic cell, e.g., a chlor-alkali electrolytic cell.

BACKGROUND OF THE INVENTION

Electrochemical processing of inorganic chemicals in electrolytic diaphragm cells for the production of other inorganic materials is well known. The electrolytic cell generally comprises an anolyte compartment containing an anode, a catholyte compartment containing a cathode, and a microporous diaphragm that separates the anolyte compartment from the catholyte compartment. Diaphragms are used, for example, to separate an oxidizing electrolyte from a reducing electrolyte, a concentrated electrolyte from a dilute electrolyte, or a basic electrolyte from an acidic electrolyte.

A non-limiting example of a diaphragm electrolytic cell is the electrolytic cell that is used for the electrolysis of aqueous alkali metal halide solutions (brine). In such an electrolytic cell, the diaphragm is generally formed on the cathode and separates an acidic liquid anolyte from an alkaline catholyte liquor. The electrolysis of alkali metal brine generally involves introducing liquid brine into the anolyte compartment of the cell and allowing the brine to percolate through the brine-permeable microporous diaphragm into the catholyte compartment. The microporous diaphragm is sufficiently porous to allow the hydrodynamic flow of brine through it, while at the same time inhibiting the back migration of hydroxyl ions from the catholyte compartment into the anolyte compartment. When direct current is applied to the cell, halogen gas is evolved at the anode, hydrogen gas is evolved at the cathode, and an aqueous alkali metal hydroxide solution is formed in the catholyte compartment. In the case of aqueous sodium chloride solutions, the halogen produced is chlorine and the alkali metal hydroxide formed is sodium hydroxide. Catholyte liquor comprising alkali metal hydroxide and unconverted brine is removed from the catholyte compartment of the cell.

During electrolysis, it is not unusual for the diaphragm of a diaphragm electrolytic cell to allow too high a flow of liquid anolyte into the catholyte compartment, e.g., by developing perforations (holes) in the diaphragm. When the flow of liquid anolyte is too high, the concentration of the principal product formed in the catholyte compartment is lowered, which results in increased costs for unit operations employed to work-up and purify that product, as well as an increase in the amount and cost of recycling process streams from those unit operations. In the case of diaphragm chlor-alkali electrolytic cells, too high a flow of brine through the diaphragm is evidenced by lower than desired concentrations of alkali metal hydroxide and higher than desired concentrations of hypochlorite ion in the catholyte liquor. When such a condition exists, there is a need for means to lower the flow of anolyte through the diaphragm, e.g., through perforations that may have developed in the diaphragm during electrolysis.

BRIEF SUMMARY OF THE INVENTION

In one non-limiting embodiment of the present invention, there is provided a method for improving the operation of an electrolytic cell which method comprises introducing ceramic fiber into the anolyte compartment in amounts sufficient to lower the flow of liquid anolyte through the diaphragm into the catholyte compartment. In general, the ceramic fiber is introduced into the anolyte compartment while the cell is operating, e.g., during electrolysis. In an alternate non-limiting embodiment, the ceramic fiber is introduced into the anolyte compartment when the electrolytic cell is off line, i.e., when no electric field, e.g., current, is applied to the cell. In a further non-limiting embodiment of the present invention, dopant materials and/or halogen-containing polymer fibers, e.g., fluorocarbon fibers, are introduced into the anolyte compartment in conjunction with the ceramic fibers.

DETAILED DESCRIPTION OF THE INVENTION

For purposes of this specification (other than in the operating examples), unless otherwise indicated, all numbers expressing quantities and ranges of ingredients, process conditions, etc are to be understood as modified in all instances by the term "about". Accordingly, unless indicated to the contrary, the numerical parameters set forth in this specification and attached claims are approximations that can vary depending upon the desired results sought to be obtained by the present invention. At the very least, and not as an attempt to limit the application of the doctrine of equivalents to the scope of the claims, each numerical parameter should at least be construed in light of the number of reported significant digits and by applying ordinary rounding techniques. Further, as used in this specification and the appended claims, the singular forms "a", "an" and "the" are intended to include plural referents, unless expressly and unequivocally limited to one referent.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements including that found in measuring instruments. Also, it should be understood that any numerical range recited herein is intended to include all sub-ranges subsumed therein. For example, a range of "1 to 10" is intended to include all sub-ranges between and including the recited minimum value of 1 and the recited maximum value of 10, that is having a minimum value equal to or greater than 1 and a maximum value of equal to or less than 10. Because the disclosed numerical ranges are continuous, they include every value between the minimum and maximum values. Unless expressly indicated otherwise, the various numerical ranges specified in this application are approximations.

As used in the following description and claims, the following terms have the indicated meanings:

The term "ceramic fiber" means inorganic, non-metallic fibers comprising one or more of the oxides, nitrides, carbides, borides and silicates of metals or semi-metals that are at least partially resistant to the corrosive conditions within the anolyte compartment of the electrolytic cell into which the ceramic fibers are introduced. The metals and semi-metals include, but are not limited to, vanadium, zirconium, niobium, molybdenum, hafnium, tantalum, titanium, tungsten, silicon, aluminum, boron, iron, cobalt, nickel, copper, zinc, cadmium, cerium, lanthanum, yttrium, calcium, barium, magnesium, beryllium, tin, lead, gallium and germanium. Generally, the metals and semi-metals will be chosen from zirconium, titanium, silicon, aluminum, boron, and magnesium. The ceramic fiber can be a synthetic material or a naturally occurring mineral, and in a non-limiting embodiment is non-conductive.

The term "chlor-alkali cell" or terms of like import means an electrolytic cell for the production of halogen, e.g., chlorine, and alkali metal hydroxide, e.g., sodium hydroxide and potassium hydroxide, by the electrolysis of aqueous alkali metal halide solutions, e.g., sodium chloride brine. The chlor-alkali cell described in this description is a diaphragm electrolytic cell.

The term "diaphragm" means a microporous, liquid electrolyte permeable material that separates the anolyte compartment from the catholyte compartment of a diaphragm electrolytic cell. In the case of a chlor-alkali electrolytic cell, the diaphragm may be, but is not limited to, an asbestos-type diaphragm, including the so-called polymer- or resin-modified asbestos diaphragm, e.g., asbestos in combination with polymeric resins such as fluorocarbon resins, or it may be a synthetic diaphragm.

The term "electrolytic diaphragm cell" or "electrolytic cell" means an electrolytic cell for conducting an electrochemical process wherein an electrolyte is passed through a diaphragm that separates the anolyte and catholyte compartments of the cell. In response to an electrical field that is generated between an anode contained in the anolyte compartment and a cathode contained in the catholyte compartment, the electrolyte is dissociated to synthesize chemical materials, e.g., inorganic materials. In one non-limiting embodiment, the electrolytic cell is a chlor-alkali cell wherein, for example, aqueous sodium chloride brine undergoes electrolysis to produce sodium hydroxide in the catholyte compartment and chlorine gas in the anolyte compartment.

The terms "on", "appended to", "affixed to", "adhered to" or terms of like import means that the referenced material is either directly connected to (superimposed on) the described surface, or indirectly connected to the object surface through one or more other layers (superposed on).

The term "perforation", as used in connection with the diaphragm of the electrolytic cell, means openings, e.g., holes, tears, etc, in the diaphragm through which the anolyte passes, which openings are of a size that cause the concentration of the principal product formed in the catholyte compartment to be reduced to a level below that which is desired, e.g., to a level below that which generally occurs during normal operation of the electrolytic cell.

The term "synthetic diaphragm" means a diaphragm that is primarily comprised of fibrous organic polymeric materials that are substantially resistant to the internal corrosive conditions present in the electrolytic cell, e.g., a chlor-alkali electrolytic cell, particularly the corrosive environments found in the anolyte and catholyte compartments of the cell. In one non-limiting embodiment, the synthetic diaphragm is substantially free of asbestos, i.e., the synthetic diaphragm contains not more than 5 weight percent of asbestos. In alternate non-limiting embodiments, the synthetic diaphragm contains not more than 3, e.g., not more than 2 or 1, weight percent of asbestos. In a further non-limiting embodiment, the synthetic diaphragm is totally free of asbestos (a non-asbestos-containing diaphragm).

The term "at least partially resistant to the corrosive conditions within the anolyte compartment" or a term of like import, as used in reference to the ceramic fiber, means that the ceramic fiber is resistant to chemical and/or physical degradation, e.g., chemical dissolution and/or mechanical erosion, by the conditions within the anolyte compartment for a reasonable period of time. Generally, a reasonable period of time will depend upon and be a function of the cell's operating conditions. In a non-limiting embodiment, a cell treated with ceramic fiber will return to acceptable levels of operation for at least 2 weeks before the addition of further amounts of the ceramic fiber may be required. In an alternate non-limiting embodiment, the cell that has been treated with ceramic fiber will return to acceptable levels of operation for from 2 to 12 weeks or more before the addition of further amounts of ceramic fiber may be required. Acceptable levels of operation are generally the operating conditions that existed for the particular treated cell prior to the event(s) that necessitated addition of the ceramic fiber.

The term "dopant material" means inorganic particulate material that is applied to the diaphragm, e.g., to the surface of the diaphragm, to regulate the microporosity of the diaphragm. Dopant materials are applied to the diaphragm when it is first prepared, and during operation of the electrolytic cell to adjust the microporosity of the diaphragm. In a non-limiting embodiment, the dopant material includes inorganic particulate material that comprises the topcoat applied to the diaphragm. Non-limiting examples of dopant materials include clay minerals, the oxides of valve metals, e.g., titanium and zirconium, and the oxides and hydroxides of alkaline earth metals, e.g., magnesium.

The term "fluorocarbon fiber" means fluorine-containing polymeric hydrocarbon fibers, e.g., polytetrafluoroethylene. The fluorocarbon fiber may also contain other halogens, e.g., chlorine, such as polychlorotrifluoroethylene, and can be comprised of a mixture of halogen-containing polymer fibers.

For purposes of convenience, the following disclosure is directed specifically to chlor-alkali electrolytic cells; but as one skilled in the art can appreciate, the method of the present invention is also applicable to other diaphragm-containing electrolytic cells that are used for the conducting an electrochemical process. In a non-limiting embodiment, the electrochemical process is used for the electrolysis of inorganic materials, e.g., aqueous inorganic metal salt solution such as sodium chloride brine.

A variety of electrolytic cells (electrolyzers) known to those skilled in the art can be used for the electrolysis of aqueous alkali metal halide solutions. In a non-limiting embodiment, the electrolyzers are monopolar or bipolar cells that contain planar and non-planar electrodes, e.g., cathodes. Generally, electrolysis is performed in a plurality of housings comprising a plurality of individual electrolytic cell units wherein a succession of anode units alternate with cathode assemblies. In one non-limiting embodiment, the electrolyzer is a bipolar electrolyzer wherein substantially vertical cathodes are interleaved or positioned within and spaced from substantially vertical anodes. This type of electrode assembly has been referred to as a fingered configuration, e.g., wherein a series of cathode fingers and anode fingers are interleaved with one another.

The cathode of a diaphragm electrolytic cell generally comprises a liquid-permeable substrate, e.g., a foraminous metal cathode. The cathode is electroconductive and may be a perforated sheet, a perforated plate, metal mesh, expanded metal mesh, woven screen, an arrangement of metal rods or the like having equivalent openings (nominal diameter) generally in the range of from 0.05 inch (0.13 cm) to 0.125 inch (0.32 cm). In an alternate non-limiting embodiment, the openings in the foraminous metal cathode range from 0.07 inch (0.17 cm) to 0.1 inch (0.25 cm). The cathode is typically fabricated of iron, an iron alloy or some other metal, such as nickel, that is resistant to the corrosive conditions within the operating electrolytic cell environment to which the cathode is exposed, e.g., the corrosive conditions with the anolyte and catholyte compartments of an operating chlor-alkali electrolytic cell.

Electrolysis of alkali metal halide brines typically involves charging an aqueous solution of the alkali metal halide salt, e.g., sodium chloride brine, to the anolyte compartment of the cell. The alkali metal halide brine typically contains alkali metal halide in an amount of from 24 to 26 percent by weight. The aqueous brine percolates through the liquid-permeable microporous diaphragm into the catholyte compartment and then is withdrawn from the cell. With the application of an electric potential across the anodes and cathodes of the cell, e.g., by the use of direct electric current, electrolysis of a portion of the percolating alkali metal halide occurs, and halogen gas, e.g., chlorine, is produced at the anode, while hydrogen gas is produced at the cathode. An aqueous solution of alkali metal hydroxide, e.g., sodium hydroxide, is produced in the catholyte compartment from the combination of alkali metal ions with hydroxyl ions. The resultant catholyte liquor, which comprises principally alkali metal hydroxide and depleted alkali metal halide brine, is withdrawn from the catholyte compartment. The alkali metal hydroxide product is subsequently separated from the catholyte liquor.

Historically, asbestos has been the most common diaphragm material used in chlor-alkali electrolytic diaphragm cells for the electrolysis of alkali metal halide brines because of its chemical resistance to the corrosive conditions that exist in such electrolytic cells. Asbestos in combination with various polymeric resins, particularly fluorocarbon resins (the so-called polymer- or resin-modified asbestos diaphragms) have been used also as diaphragm materials in such electrolytic cells. Due in part to possible health and safety issues associated with air-borne asbestos fibers resulting from the use of asbestos in other applications, synthetic diaphragms, e.g., non-asbestos-containing diaphragms, have been developed for use in chlor-alkali diaphragm electrolytic cells.

Synthetic diaphragms are generally fabricated from fibrous polymeric materials that are resistant to the corrosive conditions present within the electrolytic cell, such as a chlor-alkali cell, e.g., the corrosive environments found in the anolyte and catholyte compartments. Generally, the synthetic diaphragm is formed on the foraminous cathode by vacuum depositing (in one or more steps) the materials comprising the diaphragm onto the foraminous cathode substrate from an aqueous slurry of those materials.

In a non-limiting embodiment, synthetic diaphragms used in chlor-alkali electrolytic cells, can be prepared using fibrous organic polymers. Known useful fibrous organic polymers include, but are not limited to, a polymer, copolymer, graft polymer or combinations of polymers that are substantially chemically resistant to the corrosive conditions in which the diaphragm is employed, e.g., chemically resistant to degradation by exposure to the reactants, products and co-products present in the anolyte and catholyte compartments. Such products include, but are not limited to sodium hydroxide, chlorine and hydrochloric acid.

In a non-limiting embodiment, the fibrous organic polymers are halogen-containing polymer fibers. In an alternate non-limiting embodiment, the halogen-containing polymer fiber is a fluorocarbon fiber. Non-limiting examples of halogen-containing polymer fibers include fluorine- and fluorine and chlorine-containing polymers, such as perfluorinated polymers, and chlorine-containing polymers that include fluorine. Examples of such halogen-containing polymers and copolymers include, but are not limited to, polymers, such as polyvinyl fluoride, polyvinylidene fluoride, polytetrafluoroethylene (PTFE), polyperfluoro(ethylene-propylene), polytrifluoroethylene, polyfluoroalkoxyethylene (PFA polymer), polychlorotrifluoroethylene (PCTFE polymer) and the copolymer of chlorotrifluoroethylene and ethylene (CTFE polymer). Generally, the synthetic diaphragm is formed from a composition comprising polytetrafluoroethylene.

An important property of the synthetic diaphragm is its ability to wick (wet) the electrolyte, e.g., the aqueous alkali metal halide solution, which percolates through the diaphragm. To provide the property of wettability, the synthetic diaphragm generally further comprises ion-exchange materials having cation selective groups thereon, e.g., acid groups. In one non-limiting embodiment, the acid groups include, but are not limited to, sulfonic acid groups, carboxylic acid groups and their derivatives, e.g., esters, phosphonic acid groups, and phosphoric acid groups. Generally, the acid group is either a sulfonic acid groups or a carboxylic acid group.

In a non-limiting embodiment, the ion-exchange material is a perfluorinated copolymer material prepared from the polymerization of a fluorovinyl ether monomer containing a functional group, e.g., an ion-exchange group or a functional group easily converted into an ion-exchange group, and a monomer chosen from fluorovinyl compounds, such as vinyl fluoride, vinylidene fluoride, trifluoroethylene, tetrafluoroethylene, hexafluoroethylene, hexafluoropropylene, chlorotrifluoroethylene and perfluoro(alkylvinyl ether), with the alkyl being an alkyl group containing from 1 to 10 carbon atoms. A description of such ion-exchange materials can be found in column 5, line 36 through column 6, line 2 of U.S. Pat. No. 4,680,101, which disclosure is incorporated herein by reference. Generally, an ion-exchange material with sulfonic acid functionality is used. A perfluorosulfonic acid ion-exchange material (5 weight percent solution) is available from E. I. du Pont de Nemours and Company under the trade name NAFION. Other appropriate halogenated ion-exchange materials that can be used to allow the diaphragm to be wetted by the aqueous brine fed to the anolyte compartment of the electrolytic cell include, for example, the ion-exchange material available from Asahi Glass Company, Ltd. under the trade name FLEMION.

Organic polymeric materials in the form of microfibrils are also generally used to prepare synthetic diaphragms. Such microfibrils can be prepared in accordance with the method described in U.S. Pat. No. 5,030,403, the disclosure of such method being incorporated herein by reference. The fibers and microfibrils of the organic polymeric material, e.g., PTFE fibers and PTFE microfibrils, generally comprise the predominant portion of the diaphragm solids. As the ion-exchange material is often more costly than the polymer fibers and microfibrils, the diaphragm generally comprises from 65 to 93 percent by weight combined of such fibers and microfibrils and from 0.5 to 2 percent by weight of the ion-exchange material.

The organic fibrous polymers of the synthetic diaphragm are generally used in particulate form, e.g., in the form of particulates or fibers, as is well known in the art. In the form of fibers, the organic polymer material generally has a fiber length of up to 0.75 inch (1.91 cm) and a diameter of from 1 to 250 microns. Polymer fibers comprising the diaphragm can be of any suitable denier, e.g., commercially available fibers. In one non-limiting embodiment, the PTFE fiber used to prepare synthetic diaphragms is a 0.25 inch (0.64 cm) chopped 6.6 denier fiber; however, other lengths and fibers of smaller or larger deniers can be used.

In addition to the aforedescribed fibers and microfibrils of halogen-containing polymers and ion-exchange materials, the liquid slurry used to deposit the synthetic diaphragm on the foraminous cathode can also include other materials. Such other materials include, but are not limited to, materials such as thickeners, surfactants, antifoaming agents, antimicrobial agents and other polymers, e.g., polyethylene. Further, materials such as fiberglass can also be incorporated into the diaphragm. A non-limiting example of the components of a synthetic diaphragm material useful in a chlor-alkali electrolytic cell can be found in Example 1 of U.S. Pat. No. 5,188,712, the disclosure of which synthetic diaphragm composition is incorporated by reference.

Synthetic diaphragms can also comprise various modifiers and additives, including but not limited to, inorganic fillers, such as clays, metal oxides, pore formers, wetting agents, etc, as is well known in the art. Synthetic diaphragms can comprise one or more layers of modifiers and additives that are deposited on and within the interstices of the diaphragm comprising the fibrous halogen-containing polymer, e.g., one or more top coats of vacuum deposited modifiers and additives, as is known to those skilled in the art.

The diaphragm of an electrolytic cell, e.g., a chlor-alkali electrolytic cell, is generally deposited onto the foraminous cathode from a slurry of components comprising the diaphragm. In one non-limiting embodiment, the slurry comprises an aqueous liquid medium such as water. Such an aqueous slurry generally comprises from 1 to 6 weight percent solids, e.g., from 1.5 to 3.5 weight percent solids, of the diaphragm components, and has a pH of between 8 and 11. The appropriate pH can be obtained by the addition of an alkaline reagent, such as alkali metal hydroxide, e.g., sodium hydroxide, to the slurry.

The amount of each of the components comprising the synthetic diaphragm can vary in accordance with variations known to those skilled in the art. In one non-limiting embodiment, the following approximate amounts (as a percentage by weight of the total slurry having a percent solids of between 1 and 6 weight percent) of the diaphragm components in a slurry used to deposit a synthetic diaphragm can be used: polyfluorocarbon fibers, e.g., PTFE fibers,—from 0.25 to 1.5 percent; polyfluorocarbon microfibrils, e.g., PTFE microfibrils,—from 0.6 to 3.8 percent; ion-exchange material, e.g., NAFION resin,—from 0.01 to 0.05 percent; fiberglass—from 0.0 to 0.4 percent; and polyolefin, e.g., polyethylene, such as SHORT STUFF,—from 0.06 to 0.3 percent.

The aqueous slurry comprising the synthetic diaphragm components can also contain a viscosity modifier or thickening agent to assist in the dispersion of the solids, e.g., the perfluorinated polymeric materials, in the slurry. For example, a thickening agent such as CELLOSIZE® materials can be used. In a non-limiting embodiment, from 0.1 to 5 percent by weight of thickening agent can be added to the slurry mixture, basis the total weight of the slurry. In an alternate non-limiting embodiment, from 0.1 to 2 percent by weight thickening agent can be used.

A surfactant may, if desired, be added to an aqueous slurry of synthetic diaphragm components to assist in obtaining an appropriate dispersion. In one non-limiting embodiment, the surfactant is a nonionic surfactant and is used in amounts of from 0.1 to 3 percent, e.g., from 0.1 to 1 percent, by weight, based on the total weight of the slurry. In a non-limiting embodiment, the nonionic surfactant is a chloride capped ethoxylated aliphatic alcohols, wherein the hydrophobic portion of the surfactant is a hydrocarbon group containing from 8 to 15, e.g., 12 to 15, carbon atoms, and the average number of ethoxylate groups ranges from 5 to 15, e.g., 9 to 10. A non-limiting example of such an nonionic surfactant is AVANEL® N-925 surfactant.

Other additives that can be incorporated into the aqueous slurry of synthetic diaphragm forming components include, but are not limited to, antifoaming amounts of an antifoaming agent, such as UCON® 500 antifoaming compound, to prevent the generation of excessive foam during mixing of the slurry, and an antimicrobial agent to prevent the digestion of cellulose-based components by microbes during storage of the slurry. A non-limiting example of an antimicrobial is UCARCIDE® 250, which is available from the Dow Chemical Company. Other antimicrobial agents known to those skilled in the art also can be used. Generally, antimicrobials are incorporated into the aqueous slurry of synthetic diaphragm components in amounts of from 0.05 to 0.5 percent by weight, e.g., between 0.08 and 0.2 weight percent.

The diaphragm of an electrolytic cell, e.g., a chlor-alkali electrolytic cell, is liquid-permeable, thereby allowing an electrolyte, such as sodium chloride brine, subjected to a pressure gradient to pass through the diaphragm. Generally, the pressure gradient in a diaphragm electrolytic cell is the result of a hydrostatic head on the anolyte side of the cell, e.g., the liquid level in the anolyte compartment will be on the order of from 1 to 25 inches (2.54-63.5 cm) higher than the liquid level of the catholyte compartment. The specific flow rate of electrolyte through the diaphragm can vary with the type of the cell, and how it is used. In a chlor-alkali cell, the diaphragm is microporous and is prepared in such a manner that it is able to pass from 0.001 to 0.5 cubic centimeters of anolyte per minute per square centimeter of diaphragm surface area. The flow rate is generally set at a rate that allows production of a predetermined, targeted concentration of the principal product formed in the catholyte compartment. In a chlor-alkali electrolytic cell, the principal product formed in the catholyte compartment is alkali metal hydroxide, e.g., sodium hydroxide. Generally, synthetic diaphragms used in chlor-alkali cells, will have a porosity (permeability) similar to that of asbestos-type and polymer resin modified asbestos diaphragms.

The thickness of the diaphragm used in electrolytic cells can vary and will depend on the type of electrolytic cell used and the nature of the electrochemical process being performed. In the case of chlor-alkali electrolytic cells, diaphragms, e.g., synthetic diaphragms, generally have a thickness of from 0.075 to 0.25 inches (0.19 to 0.64 cm), and a weight per unit area ranging from 0.3 to 0.6 pounds per square foot (1.5 to 2.9 kilograms per square meter) of the cathode.

As previously stated, it is common to apply (usually by vacuum deposition) one or more coatings of water-insoluble, inorganic particulate material on top of and within the interstices of the diaphragm, e.g., the synthetic diaphragm, to control the microporosity of the diaphragm. Details of such coatings and the methods used to form such coatings can be found in U.S. Pat. Nos. 4,869,793, 5,612,089, 5,683,749, 6,059,944 and 6,299,939 B1. Such coating(s) are generally referred to as topcoats and are generally deposited on the diaphragm by drawing an aqueous slurry comprising the inorganic particulate material through the previously formed diaphragm by use of a vacuum.

As described in column 2, line 65 through column 6, line 65 of the '939 patent, which disclosure is incorporated by reference, the inorganic particulate material present in the top coat slurry may be selected from (i) oxides, borides, carbides, silicates and nitrides of valve metals, (ii) clay mineral, and (iii) mixtures of (i) and (ii). In one non-limiting embodiment, the inorganic particulate material is substantially water-insoluble. The term "valve metal" includes the metals vanadium, chromium, zirconium, niobium, molybdenum, hafnium, tantalum, titanium, tungsten and mixtures of such metals. Of the previously described valve metals, titanium and zirconium are generally the metals chosen. Of the valve metal oxides, borides, carbides and silicates, valve metal oxides and silicates are generally the materials used. Non-limiting examples of valve metal oxides include titanium oxide and zirconium oxide.

Non-limiting examples of clay minerals that may be present in the topcoat slurry include the naturally occurring hydrated silicates of metals, such as aluminum and magnesium, e.g., kaolin, meerschaums, augite, talc, vermiculite, wollastonite, montmorillonite, illite, glauconite, attapulgite, sepiolite and hectorite. Of the aforementioned clay minerals, attapulgite and hectorite and mixtures of such clays are generally chosen. Such clays are hydrated magnesium silicates and magnesium aluminum silicates, which materials may also be prepared synthetically. Attapulgite clay is available commercially under the trade name ATTAGEL.

The mean particle size of the inorganic particulate material used in the topcoat slurry or as a dopant material can vary. In one non-limiting embodiment, the mean particle size may range from 0.1 to 20 microns, e.g., from 0.1 to 0.5 microns. For example, one commercially available attapulgite clay has a mean particle size of 0.1 microns.

The amount of inorganic particulate material in the topcoat slurry can vary and will depend on the amount that is required for the particular diaphragm. In one non-limiting embodiment, the topcoat slurry can contain from 1 to 15 grams per liter (gpl) of inorganic particulate material. In alternate non-limiting embodiments, the amount of inorganic particulate in the topcoat slurry may vary from 5 to 15 gpl, e.g., 8 to 12 gpl.

The topcoat slurry may also comprise alkali metal polyphosphate, e.g., sodium polyphosphate, potassium polyphosphate and mixtures of such polyphosphates. The polyphosphate may be a hydrated polyphosphate, a dehydrated polyphosphate or a mixture of hydrated and dehydrated polyphosphates. In a non-limiting embodiment, the alkali metal polyphosphate may be present in the topcoat slurry in an amount of at least 0.01 weight percent. In an alternate non-limiting embodiment, the alkali metal polyphosphate may be present in amounts of at least 0.1 weight percent. Generally, the alkali metal polyphosphate is present in the topcoat slurry in amounts of less than 2 weight percent. In alternate non-limiting embodiments, the alkali metal polyphosphate is present in the topcoat slurry in amounts of less than 1 weight percent, e.g., less than 0.5 weight percent. The amount of alkali metal polyphosphate present in the topcoat slurry can range between any of the aforedescribed upper and lower values, inclusive of the recited values.

Non-limiting examples of alkali metal polyphosphates include tetraalkali metal pyrophosphate, e.g., tetra sodium pyrophosphate and tetra potassium pyrophosphate, alkali metal triphosphate, e.g., sodium triphosphate and potassium triphosphate, alkali metal tetraphosphate, e.g., sodium tetraphosphate, alkali metal hexametaphosphate, e.g., sodium hexametaphosphate, and mixtures of such polyphosphates.

During operation of a diaphragm electrolytic cell, i.e., during electrolysis of the electrolyte charged to the anolyte compartment, e.g., alkali metal halide brine, one or more perforations in the diaphragm, e.g., tears, holes, etc can develop. Such perforations are larger than the pores that are present in the microporous diaphragm during normal operation of the electrolytic cell, e.g., the pores that define the microporosity of the diaphragm. The root cause of such perforation(s) is not known for certain. However, as a result of such perforation(s), the catholyte in the catholyte compartment is diluted with electrolyte due to the increase in the flow of electrolyte through the diaphragm. The dilution effect is evidenced, for example, by a decrease in the concentration of the principal product formed in the catholyte compartment.

In the case of a chlor-alkali electrolytic cell, e.g., a cell in which alkali metal chloride is electrolyzed, the concentration of the aqueous alkali metal hydroxide in the catholyte liquor, e.g., sodium hydroxide, in the catholyte liquor decreases. In one non-limiting embodiment, the decrease in the concentration of the aqueous alkali metal hydroxide that is observed as a result of perforations occurring in the diaphragm can be 2 percent or more. In other non-limiting embodiments, the observed decrease in alkali metal hydroxide in the catholyte liquor as a result of perforations in the diaphragm can be as much as from 3 to 70 percent, e.g., from 3 to 40 percent. Periodic chemical analysis of the catholyte liquor withdrawn from the catholyte compartment will evidence this decrease in the alkali metal hydroxide concentration and indicate that there are perforations in the diaphragm. An aqueous alkali metal hydroxide solution product of diminished concentration results in increased process costs in order to evaporate the excess water present in the alkali metal hydroxide recovered from the catholyte liquor in order to bring the alkali metal hydroxide solution to a concentration that is sold commercially.

Further, in the case of alkali metal halide, e.g., sodium chloride, electrolysis, an increase in the concentration of hypohalite ion, e.g., hypochlorite ion, as alkali metal hypohalite is also observed in the catholyte liquor. Generally, the concentration of hypohalite ion in the catholyte liquor of a good operating chlor-alkali electrolytic cell will range from 0 to 10 parts per million (ppm), e.g., 3 to 10 ppm. When perforations occur in the diaphragm, the hypohalite ion concentration in the catholyte liquor can increase to levels of 150 ppm or more. Chemical analysis of the catholyte liquor removed from the catholyte will provide the hypohalite concentration present therein (as alkali metal hypohalite such as sodium hypochlorite) and is further indicative if a perforation is present in the diaphragm. In one non-limiting embodiment, the concentration of hypohalite ion in the catholyte liquor as a result of perforation(s) in the diaphragm can range from 20 to 150 ppm. In alternate non-limiting embodiments, the increase in hypohalite concentration in the catholyte liquor as a result of perforation(s) in the diaphragm can range from 25 to 100 ppm, e.g., 25 to 50 ppm. The increase in hypohalite concentration in the catholyte liquor can range between any combination of the described concentrations, inclusive of the recited concentrations.

In accordance with a non-limiting embodiment of the present invention, ceramic fiber is introduced into the anolyte compartment in an amount sufficient to reduce the flow of liquid anolyte (electrolyte) through the diaphragm into the catholyte compartment, e.g., an effective amount. In an alternate non-limiting embodiment, ceramic fiber is introduced into the anolyte compartment in amounts sufficient to reduce the flow of anolyte (electrolyte) through the diaphragm to a value within the desired operating range chosen for the treated cell. In the case of a chlor-alkali cell, the flow rate of anolyte through the diaphragm is typically within the range of from 0.001 to 0.5 cubic centimeters per minute per square centimeter of effective diaphragm surface area. In accordance with another non-limiting embodiment, ceramic fiber is introduced into the anolyte compartment while the cell is operating.

In a non-limiting embodiment of the present invention and in the case of chlor-alkali electrolytic cells, the amount of ceramic fiber introduced into the anolyte compartment is an amount sufficient to increase the concentration of alkali metal hydroxide, e.g., sodium hydroxide, in the catholyte liquor. In an alternate non-limiting embodiment of the present invention, the amount of ceramic fiber introduced into the anolyte compartment is an amount sufficient to reduce the concentration of hypohalite ion, e.g., hypochlorite ion such as sodium hypochlorite. In a non-limiting embodiment, the increase in alkali metal hydroxide concentration and the decrease in hypohalite ion concentration in the catholyte liquor are to at least substantially the same respective concentrations that existed in the catholyte liquor prior to the conditions that gave rise to the need for adding ceramic fiber to the anolyte compartment. In a non-limiting embodiment, the increase in alkali metal hydroxide concentration and decrease in hypohalite ion concentration are those respective concentrations that are within the range established for a good operating electrolytic cell, e.g., standard operating conditions for a cell of the type treated.

In a non-limiting embodiment, the ceramic fiber may be introduced batch wise into the anolyte compartment. In an alternate non-limiting embodiment, ceramic fiber may be introduced continuously into the anolyte compartment. Regardless of the manner by which ceramic fiber is introduced into the anolyte compartment, e.g., periodically or continuously, the ceramic fiber can in alternate non-limiting embodiments be introduced dry, as a wetted fiber or in the form of a slurry, e.g., an aqueous slurry. In the case of an aqueous slurry, the aqueous portion of the slurry can be, but is not limited to, water, anolyte feed, e.g., brine, recycled anolyte liquor, or mixtures of such aqueous liquids. Generally, water or brine feed is used to prepare the slurry. Generally, the ceramic fiber is introduced periodically, e.g., batchwise, into the anolyte compartment.

In a non-limiting embodiment, ceramic fiber is introduced into the anolyte compartment until the concentration of principal product in the catholyte liquor returns to the desired level. In the case of a chlor-alkali cell, ceramic fiber can be introduced into the anolyte compartment until the concentrations of alkali metal hydroxide and/or hypohalite ion have returned to their desired levels. Chemical analysis of the catholyte liquor subsequent to the initial introduction of ceramic fiber to the anolyte compartment and after equilibrium within the cell is substantially attained will determine if sufficient ceramic fiber has been introduced to bring the cell back to its desired operating conditions, or whether additional amounts of ceramic fiber are required to rectify the increased flow of anolyte through the diaphragm. Such chemical analyses are good indicators of whether the flow of anolyte liquor through the diaphragm is excessive or whether it is within the range of standard cell operating conditions. Periodic chemical analysis of the catholyte liquor after ceramic fiber addition avoids producing an operating condition where the flow of anolyte liquor through the diaphragm becomes too low. The steps of catholyte liquor analysis and ceramic fiber addition to the anolyte compartment can be repeated until the cell returns to a desired operating condition.

The amount of ceramic fiber introduced into the anolyte compartment can vary. In a non-limiting embodiment, the amount of ceramic fiber charged to the anolyte compartment during each occurrence of ceramic fiber addition can range from 0.1 to 30 grams of ceramic fiber per square foot of effective diaphragm surface area (the surface area through which electrolyte passes into the catholyte compartment). In alternate non-limiting embodiments, the amount of ceramic fiber introduced into the anolyte compartment can range from 0.1 to 10 grams of ceramic fiber per square foot of effective diaphragm surface area, e.g., from 0.1 to 8.5 grams per square foot of effective diaphragm surface area. In a further non-limiting embodiment, the amount of ceramic fiber introduced into the anolyte compartment can range from 0.1 to 5, e.g., 0.3 to 3, grams of ceramic fiber per square foot of effective diaphragm surface area. The amount of ceramic fiber introduced into the anolyte compartment can vary between any combination of the stated values, including the recited amounts. Care should be observed that the amount of ceramic fiber added to the anolyte is not excessive, thereby resulting in either plugging of the diaphragm or reducing the flow of electrolyte through the diaphragm to rates significantly below that of normal operating conditions.

The ceramic fiber is at least partially resistant to the corrosive conditions within the anolyte of the electrolytic cell, e.g., oxidizing conditions, pH and temperature. For example, in a chlor-alkali electrolytic cell, the pH of the anolyte is generally acidic. Moreover, corrosive conditions within the anolyte compartment of the chlor-alkali cell can be caused by the presence of chlorine, hydrochloric acid, hypochlorous acid, chlorate ions and oxygen within the anolyte compartment. Further, it is possible for the ceramic fibers to be exposed to alkaline materials, e.g., hydroxides, that are present on or in the diaphragm or that back migrate from the catholyte department, which may also cause chemical degradation of the ceramic fibers. In addition, the ceramic fibers may be eroded by mechanical forces operating within the anolyte compartment or be dissolved chemically by the chemicals present within the anolyte compartment. In such an event, perforations in the diaphragm are likely to reoccur. Generally, the perforations will reoccur gradually, as evidenced for example by the dilution of the concentration of the principal product within the catholyte compartment. In such an event, the addition of further quantities of ceramic fiber to the anolyte compartment may be required.

The ceramic fiber material introduced into the anolyte compartment is at least partially resistant to degradation/dissolution by the chemical and mechanical forces within the anolyte compartment for a reasonable period of time. The period of time that the ceramic fibers perform their function of reducing the flow of anolyte into the catholyte compartment (as a result of perforations in the diaphragm) can vary, and will be a function of the ceramic fiber used, the conditions within the electrolytic cell, e.g., turbulence, power (load) variations, outages and the previously described chemically corrosive conditions. In a non-limiting embodiment, the electrolytic cell will operate at substantially the operating conditions for that particular cell after the addition of ceramic fiber to mend perforations in the diaphragm for from approximately 2 to 12 weeks or longer, although shorter periods of time can be expected in some cases.

Examples of ceramic fiber materials include, but are not limited to, silicon dioxide, silicon nitride, silicon carbide, zirconium dioxide, zirconium diboride, zirconium silicate, boron nitride, boron oxide ($B_2O_3$), germanium dioxide, aluminum oxide, aluminum silicates, aluminum nitride, silicon carbide, tin oxide, iron silicide, molybdenum disilicide, hafnium oxide, titanium suboxides, titanium dioxide, titanium carbide, titanium diboride, titanate fibers, such as the alkali titanates represented by the formulae $M_2O.4TiO_2$ and $M_2O.6TiO_2$, wherein M is the alkali metal sodium, potassium, rubidium or cesium, e.g., potassium tetratitanate ($K_2Ti_4O_9$), mixtures of alumina and silica, e.g., blends of from 46 to 96 weight percent alumina and 4 to 54 weight percent silica, which are available under the trade names KAOWOOL, CERAFIBER and SAFFIL, and blends of alumina, silica and other metal oxides such as zirconia, chromium oxide, or boron oxide, which are available under the trade names CERACHEM and CERACHROME (available commercially from Thermal Ceramics Inc), and NEXTEL (available from the 3M Company). Other non-limiting examples of ceramic fibers include yttrium aluminum garnet (YAG) and lead zirconate titanate (PZT)

The ceramic fibers can vary in length. In one non-limiting embodiment, the fiber length can range from 0.03 to 10 inches (0.07 to 25.4 centimeters). In alternate non-limiting embodiments, the fiber length can vary from 0.05 to 4 inches (0.13 to 10 centimeters), e.g., from 0.5 to 2 inches (1.3 to 5.1 centimeters). The fibers can be fibril-like, and of irregular morphology, e.g., beads, tear-drop shapes, bent-branch shapes and blobular rods. They can be amorphous, crystalline, isotropic, anisotropic and branched and/or unbranched. In one non-limiting embodiment, the width of the fibers can range from 0.1 to 10,000 microns. In alternate non-limiting embodiments, the width of the fibers can range from 0.5 to 10 microns, e.g., 3 to 5 microns. In one non-limiting embodiment, the cross-sectional morphology of the ceramic fibers is circular, e.g., as a result of circular dies used to prepare the fibers.

Ceramic fibers can be prepared by methods known to those skilled in the art. Such methods include drawing the fibers from a molten state of the chemical composition comprising the fiber and rapidly cooling the fiber. Another method that can be used is that described in column 3, lines 11-25 of U.S. Pat. No. 3,385,915, which disclosure is incorporated by reference. That described method comprises (1) impregnating a preformed organic polymeric fiber material with one or more compounds, e.g., salts or hydrolysis products of salts, of the chosen metal elements, e.g., metal elements that form oxides, and (2) heating the impregnated organic material under controlled conditions in the presence of an oxidizing gas to (a) convert the organic material to predominantly carbon and removing the carbon as a carbon-containing gas and (b) oxidize the metal compound(s) to their respective metal oxide(s).

Another method for preparing fibers of refractory material is described in column 2, lines 15-28 of U.S. Pat. No. 6,395,080 B1, which disclosure is incorporated by reference. That method comprises (1) forming a dispersion of particles of the refractory material, e.g., particles of less than 100 microns, (2) mixing the dispersion with a carrier solution of a salt of cellulose xanthate to form a spin mix, (3) forming filaments of regenerated cellulose from the spin mix using wet spinning techniques, and (4) heat treating the filaments to remove substantially all of the regenerated cellulose and sinter the particles of refractory material to form the desired fibers.

Other materials can be introduced into the anolyte compartment to work in combination with the ceramic fibers. In a non-limiting embodiment, at least one dopant material can be added to the anolyte compartment at substantially the same time as the ceramic fiber. In alternate non-limiting embodiments, dopant material can be added before or subsequent to, e.g., sequentially, to the addition of the ceramic fiber.

In a further non-limiting embodiment of the present invention, fibers comprising halogen-containing polymers, e.g., fluorocarbon polymers, can be added to the anolyte compartment of the electrolytic cell in conjunction with the ceramic fiber, e.g., at substantially the same time as the ceramic fiber. In alternate non-limiting embodiments, the fibers comprising halogen-containing polymers can be added before or subsequent to, e.g., sequentially, the addition of ceramic fibers to the anolyte compartment. In another non-limiting embodiment of the present invention, dopant material and fibers of halogen-containing polymer, e.g., fibers of fluorocarbon polymer, can be added to the anolyte compartment of the electrolytic cell to work in conjunction with the ceramic fibers. The order in which the ceramic fibers, halogen-containing polymer fibers and dopant material are added to the anolyte compartment can vary. Generally, for reasons of convenience, a mixture of one or more of the aforementioned materials, e.g., a slurry of all three of the materials, is prepared and the slurry added to the anolyte compartment.

The present invention is more particularly described in the following examples, which are intended as illustrative only, since numerous modifications and variations therein will be apparent to those skilled in the art.

In the following examples, the reported efficiencies of the chlor-alkali electrolytic cells are Oxy '6' efficiencies. These efficiencies are calculated using the following equation:

$$\text{Oxy '6' Efficiency} = \frac{\text{Volume \% } Cl_2 1}{\left[ (Vol\,\%\,Cl_2 + 2 * (Vol\,\%\,O_2)) + \frac{[6 * \text{gpl } NaClO_3] * Vol\ \%}{\text{gpl NaOH}} Cl_2 \right]}$$

wherein:

Vol % $Cl_2$ is the cell gas (air-free) % chlorine by volume,

Vol % $O_2$ is the cell gas (air free) % oxygen by volume, gpl $NaClO_3$ is the sodium chlorate concentration in grams per liter in the catholyte cell liquor, and gpl NaOH is the sodium hydroxide concentration in grams per liter in the catholyte cell liquor.

The Oxy '6' equation assumes a constant ratio of sodium chlorate in the anolyte to that in the catholyte. The * in the equation represents the times (multiplication) operator.

Commercial scale bipolar electrolyzers having 12 elements per electrolyzer were used in the following examples. Each electrolyzer element contained 44 substantially vertical cathode fingers interleaved within and spaced from substantially vertical anodes. The cathode area for each element was 416 square feet (33.6 square meters). The cathodes were provided with a non-asbestos synthetic diaphragm comprising fibrous polytetrafluoroethylene (PTFE), PTFE microfibers (fibrils), NAFION® ion exchange material having sulfonic acid functional groups, fiberglass and SHORT STUFF polyethylene fibers. The synthetic diaphragms were deposited onto the cathodes by vacuum deposition of an aqueous slurry of the materials comprising the diaphragm. The synthetic diaphragms were coated (by vacuum deposition) with inorganic particulate material. Depending on the electrolyzer element, the coating comprised either ATTAGEL® attapulgite clay and zirconium dioxide, or ATTAGEL® attapulgite clay zirconium dioxide and magnesium hydroxide The electrolyzers were used for the electrolysis of sodium chloride brine. The concentration of the brine fed to the anolyte compartment of each electrolyzer element was in the range of 318 to 322 grams per liter (gpl). The voltage and amperage applied to each electrolyzer element was in the range of 3.32 to 3.36 volts at approximately 72 kilo amperes. During steady state operation, analysis of the catholyte liquor was performed at approximately seven-day intervals. The reported Oxy '6' efficiencies are for the electrolyzer.

EXAMPLE 1

Analysis of the catholyte liquor from element No. 7 in a bipolar fingered chlor-alkali electrolyzer reported a sodium hydroxide (NaOH) concentration of 125.9 gpl, and a hypochlorite ion concentration, as sodium hypochlorite (NaOCl), of 35.5 ppm. The Oxy '6' efficiency of the electrolyzer at this time was calculated to be 95%. In the week prior to the foregoing analysis the concentration of sodium hydroxide (NaOH) was approximately 145.9 gpl, and the sodium hypochlorite ion concentration was approximately 1.6 parts per million (ppm). These analyses indicated that perforations had developed in this element.

A doping solution comprising 3 pounds (1.36 kg) of CERACHEM® HM-12 ceramic fibers and 5 pounds (2.27 kg) of ATTAGEL® 36 attapulgite clay (Engelhard Corporation) in 25 gallons (94.6 liters) of water was prepared and added to the element brine box from where it was introduced into the anolyte compartment of the electrolyzer element. Six days later, analysis of the catholyte liquor showed that the NaOH concentration had increased to 139.6 gpl and the NaOCl concentration had decreased to zero (0) ppm. CERACHEM® HM-12 is a ceramic fiber of nominally 35 weight % alumina, 50 weight percent silica and 15 weight percent zirconia. The fiber has a maximum length of 0.5 inches (1.3 cm) and is available from Thermal Ceramics Inc. The Oxy '6' efficiency of the electrolyzer at this time was calculated to be 95.2%.

Thirty five days later, the catholyte liquor from element 7 was re-analyzed. This analysis reported that the concentration of NaOH and NaOCl was 44 gpl and 96.3 ppm. An additional doping solution (in the amounts initially described) was added to the element brine box. A week later the concentrations of NaOH and NaOCl had returned to 160.9 gpl and 3.8 ppm respectively. The Oxy '6' efficiency of the electrolyzer at this time was calculated to be 93.9%.

EXAMPLE 2

Analysis of the catholyte liquor from element No. 11 in the bipolar fingered chlor-alkali electrolyzer of Example 1 reported a sodium hydroxide (NaOH) concentration of 51.2 gpl, and a hypochlorite ion concentration (as sodium hypochlorite-NaOCl) of 96.4 parts per million (ppm). The Oxy '6' efficiency of the electrolyzer at this time was calculated to be 94.4%. The foregoing reported analysis was at a point in time prior to the analysis reported for element No. 7 in Example 1.

A doping solution having the composition described in Example 1 was prepared and added to the brine box of element 11 from where it was introduced into the anolyte compartment of the electrolyzer element. Six days later, analysis of the catholyte liquor showed that the NaOH concentration to be 134.1 gpl and the NaOCl concentration to be zero (0) ppm. The Oxy '6' efficiency of the electrolyzer at this time was calculated to be 95.8%.

EXAMPLE 3

Analysis of the catholyte liquor from element No. 12 in a bipolar fingered chlor-alkali electrolyzer different from the electrolyzers of Examples 1 and 2 reported a sodium hydroxide (NaOH) concentration of 130.1 gpl, and a hypochlorite ion concentration (as sodium hypochlorite-NaOCl) of 5.3 parts per million (ppm).

A doping solution comprising 3 pounds (1.36 kg) of CERAFIBER® 112 ceramic fibers, 5 pounds (2.27 kg) of ATTAGEL® 36 attapulgite clay (Engelhard Corporation), 2 gallons (7.6 liters) of a 10% PTFE microfibril suspension (17.7 pounds microfibrils, 8 kg), approximately 1 pound (0.5 kg) of shredded synthetic PTFE diaphragm and 25 gallons (94.6 liters) of water was prepared and added to the element brine box from where it was introduced into the anolyte compartment of the electrolyzer element. Analysis of the catholyte liquor 12 days later reported that the NaOH concentration was 140.3 gpl and the concentration of NaOCl had dropped to zero (0). Thirty five days later the concentration of sodium hydroxide (NaOH) and hypochlorite ion (NaOCl) was reported to be 143.7 gpl and 0.09 ppm respectively. The Oxy '6' efficiency of the electrolyzer at this time was calculated to be 95.4%. CERAFIBER® 112 is a ceramic fiber of approximately 46 weight % alumina and 54 weight % silica having a fiber length of up to 10 inches (25.4 cm), which is available from Thermal Ceramics Inc. Shredded PTFE synthetic diaphragm is synthetic diaphragm material that has been passed through a paper shredder. The dimensions of the shredded diaphragm were approximately ⅛ inch wide×1.5 inches long×⅛ inch thick (0.3 cm×3.8 cm×0.3 cm).

EXAMPLE 4

Analysis of the catholyte liquor from element #8 in the bipolar fingered chlor-alkali electrolyzer of Example 1 reported sodium hydroxide (NaOH) and sodium hypochlorite (NaOCl) concentrations of 84 gpl and 101.2 ppm respectively. At the same time, element #11 of the same electrolyzer exhibited NaOH and NaOCl concentrations of 133 gpl and 23.78 ppm respectively.

Following the foregoing analysis, three pounds of CERACHEM® HM 12 ceramic fiber that had been wet with water were added manually to each of the element brine boxes of elements #8 and #11. Analysis of the catholyte liquors of elements #8 and #11 six days later reported NaOH concentrations of 140.4 gpl and 144.3 gpl respectively, and no detectable NaOCl concentrations in either catholyte liquor. The Oxy '6' efficiency of the electrolyzer was calculated to be 95.3%.

EXAMPLE 5

Analysis of the catholyte liquor of element #4 of a bipolar fingered chlor-alkali electrolyzer different from the electrolyzers of Examples 1-4 reported sodium hydroxide (NaOH) and hypochlorite ion, as sodium hypochlorite (NaOCl), concentrations of 96.6 gpl and 41.7 ppm respectively. The Oxy '6' efficiency of the electrolyzer was calculated to be 95.7%. Following the foregoing analysis, three pounds of CERACHEM® HM 12 ceramic fiber that had been wet with water were added manually to the element brine box of element #4. Analysis of the catholyte liquor of element #4 six days later reported a NaOH concentration of 140.5 gpl, and a NaOCl concentration of 0 ppm. The Oxy '6' efficiency of the electrolyzer was calculated to be 96.0%. Similar performance was observed for the duration of the element's life, which was approximately 75 days.

The present invention has been described with reference to specific details of particular embodiments thereof. It is not intended that such details be regarded as limitations upon the scope of the invention except insofar as and to the extent that they are included in the accompanying claims.

What is claimed is:

1. A method for improving the operation of an electrolytic cell comprising an anolyte compartment, a catholyte compartment and a synthetic diaphragm substantially free of asbestos separating the anolyte and catholyte compartments wherein liquid anolyte is introduced into the anolyte compartment and flows through the diaphragm into the catholyte compartment, which method comprises introducing synthetic ceramic fiber chosen from fibers coin rising the oxides, nitrides, carbides, borides and silicates of metals or semimetals chosen from zirconium, silicon, aluminum, boron, magnesium and in mixtures of such metal or semimetal oxides, nitrides, carbides, borides and silicates into the anolyte compartment in amounts sufficient to lower the flow of liquid anolyte through the diaphragm into the catholyte compartment.

2. The method of claim 1 wherein the electrolytic cell is a chlor-alkali electrolytic cell.

3. The method of claim 2 wherein the diaphragm of the electrolytic cell is a synthetic non-asbestos-containing diaphragm.

4. The method of claim 1 wherein the synthetic ceramic fiber is chosen from fibers comprising at least one of the oxides of silicon, aluminum and zirconium.

5. The method of claim 4 wherein synthetic ceramic fiber is introduced into the anolyte compartment while the cell is operating.

6. In the method of operating a chlor-alkali electrolytic cell comprising an anolyte compartment, a catholyte compartment and a synthetic diaphragm substantially free of asbestos separating the anolyte and catholyte compartments, wherein aqueous alkali metal chloride is introduced continuously into the anolyte compartment and passes through the diaphragm into the catholyte compartment which contains catholyte liquor comprising alkali metal hydroxide and wherein the concentration of alkali metal hydroxide in the catholyte liquor is less than the desired concentration, the improvement comprising introducing synthetic ceramic fiber chosen from fibers comprising the oxides, nitrides, carbides, borides and silicates of metals or semi-metals chosen from zirconium, silicon aluminum, boron, magnesium and mixtures of such metal or semi-metal oxides, nitrides, carbides, borides and silicates into the anolyte compartment in amounts sufficient to increase the concentration of alkali metal hydroxide in the catholyte liquor.

7. The method of claim 6 wherein the diaphragm of the chlor-alkali electrolytic cell is a synthetic non-asbestos-containing diaphragm and the alkali metal chloride is sodium chloride.

8. The method of claim 7 wherein the synthetic ceramic fiber is chosen from fibers comprising at least one of the oxides of silicon, aluminum and zirconium.

9. The method of claim 8 wherein the synthetic ceramic fibers are introduced into the anolyte compartment while the cell is operating.

10. The method of claim 9 wherein dopant material is added to the anolyte in conjunction with the ceramic fibers.

11. The method of claim 10 wherein fibers comprising halogen-containing polymer are added in conjunction with the synthetic ceramic fibers.

12. The method of claim 9 wherein fibers comprising fluorocarbon polymer are added in conjunction with the synthetic ceramic fibers.

13. The method of claim 12 wherein dopant material is added to the anolyte in conjunction with the ceramic fibers.

14. In the operation of a chlor-alkali electrolytic cell comprising an anolyte compartment, a catholyte compartment and a microporous synthetic diaphragm substantially free of asbestos separating the anolyte and catholyte compartments, wherein aqueous alkali metal chloride is introduced continuously into the anolyte compartment and percolates through the diaphragm into the catholyte compartment, which contains catholyte liquor comprising alkali metal hydroxide and hypochlorite ion, and wherein the concentration of hypochlorite ion in the catholyte liquor is more than the desired concentration, the improvement comprising introducing synthetic ceramic fiber chosen from fibers comprising at least on of the oxides of silicon, aluminum and zirconium into the anolyte compartment in amounts sufficient to lower the concentration of hypochlorite ion in the catholyte liquor.

15. The method of claim 14 wherein the diaphragm of the chlor-alkali electrolytic cell is a synthetic non-asbestos-containing diaphragm and the alkali metal chloride is sodium chloride.

16. The method of claim 15 wherein at least one of dopant material, fibers comprising fluorocarbon polymer and mixtures of dopant material and fluorocarbon polymer fibers are added to the anolyte compartment in conjunction with the synthetic ceramic fibers.

* * * * *